United States Patent [19]

Takiguchi et al.

[11] Patent Number: 4,779,703

[45] Date of Patent: Oct. 25, 1988

[54] SILENCING DEVICE FOR INTERNAL COMBUSTION ENGINE

[75] Inventors: Shiro Takiguchi; Isao Takahashi; Hiroo Kawakami, all of Wako; Masaki Kojima, Tokyo, all of Japan

[73] Assignees: Honda Giken Kogyo Kabushiki Kaisha; Sankei Giken Kogyo Kabushiki Kaisha, both of Tokyo, Japan

[21] Appl. No.: 34,961

[22] Filed: Apr. 6, 1987

[51] Int. Cl.[4] ..... F01N 1/02

[52] U.S. Cl. ..... 181/228; 181/255; 181/273

[58] Field of Search ..... 181/227, 228, 250–252, 181/273, 269, 255; 60/312

[56] References Cited

U.S. PATENT DOCUMENTS

| | | | |
|---|---|---|---|
| 3,338,331 | 8/1967 | Jekkinghoff | 181/227 |
| 3,543,878 | 12/1970 | Hamilton | 181/250 X |
| 3,648,803 | 3/1972 | Heath et al. | 181/250 |
| 3,780,876 | 12/1973 | Hubbell, III | 181/227 |

*Primary Examiner*—B. R. Fuller

*Attorney, Agent, or Firm*—Armstrong, Nikaido, Marmelstein & Kubovcik

[57] ABSTRACT

A silencing device for an internal combustion engine includes an expansion chamber which may be implemented with a prechamber, a muffler or the like installed in an exhaust system of the engine. An exhaust pipe connected to the expansion chamber is provided with a double-layer structure consisting of an inner conduit through which exhaust gases flow and an outer conduit which surrounds the inner conduit. An air gap defined between the inner and outer conduits is opened into the expansion chamber at one end and closed at the other end so as to serve as a resonance chamber.

3 Claims, 2 Drawing Sheets

SILENCING DEVICE FOR INTERNAL COMBUSTION ENGINE

BACKGROUND OF THE INVENTION

The present invention relates to a silencing device for attenuating exhaust noise in an exhaust system of an internal combustion engine and, more particularly, to a silencing device suitable for use with an exhaust system of the type having a double-layer exhaust pipe.

Various kinds of silencing devices are used with automotive vehicles in order to attenuate noise generated by exhaust gases which are emitted from internal combustion engines. The silencing devices known in the art may generally be classified into three types, i.e., an absorption type device, an expansion type device, and a resonance type device. The absorption type device is constructed to absorb energy of sound by use of glass wool or like sound absorbing material. The expansion type device includes an expansion chamber which is defined in a part of an exhaust pipe, so sound waves may be reflected by the wall of the chamber to cancel each other by interference. The resonance type device, which is believed to be highest in silencing performance, includes a resonance chamber which is configured to produce waves whose phases are opposite to those of incoming waves of exhaust noise. Ordinary exhaust silencing devices, or mufflers, are implemented with the combination of such three different types of devices so as to make the most of their inherent effects.

As regards the resonance type scheme, noise of low frequencies cannot be attenuated unless the resonance chamber is provide with a substantial length. However, in the case of an automotive vehicle, the space available below the frame is too limited to provide a resonance chamber in a muffler. In an ordinary muffler, therefore, it is extremely difficult for low frequency noise to be effectively attenuated.

An exhaust pipe of an automotive vehicle is often comprised of concentric inner and outer conduits so as to reduce radiation of noise and, at the same time, to thermally insulate the interior of the pipe from the outside. In such a double-layer exhaust pipe, an air gap is defined between the inner and outer conduits over a substantial length. The long air gap may be used as a resonance chamber, as disclosed in U.S. Pat. Nos. 3,780,826, 3,648,803, and 3,338,331 by way of example.

In all of the prior disclosures mentioned above, the inner conduit is formed with numerous perforations to provide communication between the inside and the outside of the inner conduit. This suffers from various drawbacks, however. Specifically, forming the perforations through the inner conduit requires extra machining steps. Moreover, because the diameter, number, positions and others of the perforations have critical influence on the resonance-based silencing effect, greatest possible care should be given to the machining. Especially, while the amount of attenuation and, therefore, the silencing effect becomes greater with the increase in the total area of the perforations, forming large openings through the wall of the inner conduit is considerably difficult. Another problem is that the perforations constitute resistance to exhaust gases which flow through the inner conduit.

SUMMARY OF THE INVENTION

It is therefore an object of the present invention to allow the air gap between the inner and outer conduits to be used as a resonance chamber without resorting to machining the inner conduit.

It is another object of the present invention to make it possible to form a large opening which communicates to the resonance chamber, thereby enhancing the silencing effect.

In order to achieve the above objects, a silencing device of the present invention includes a double-layer exhaust pipe which is connected to a prechamber, a muffler or like expansion chamber of an exhaust system of an internal combustion engine. An air gap defined between inner and outer conduits of the exhaust pipe is open into the expansion chamber at one end thereof and closed at the other end by a flange portion or the like.

In the above construction, a long air gap which is open into the expansion chamber at one end and closed at the other end is formed over a substantial length along the exhaust pipe. The air gap serves as a long resonance chamber with dead spaces effectively utilized, whereby low frequency noise in the exhaust system is effectively attenuated.

The resonance chamber which is open into the expansion chamber eliminates the need for machining such as perforating the inner conduit. In addition, because the opening of the resonance chamber is formed along the entire circumference of the inner conduit, it can be provided with an area which is wide enough to enhance the silencing effect without increasing the backpressure.

In a preferred embodiment of the present invention, the inner conduit of the exhaust pipe is protruded into the expansion chamber. This gives the resonance chamber an extra length and, thereby, allows lower frequency exhaust noise to be attenuated for a given length of exhaust pipe.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
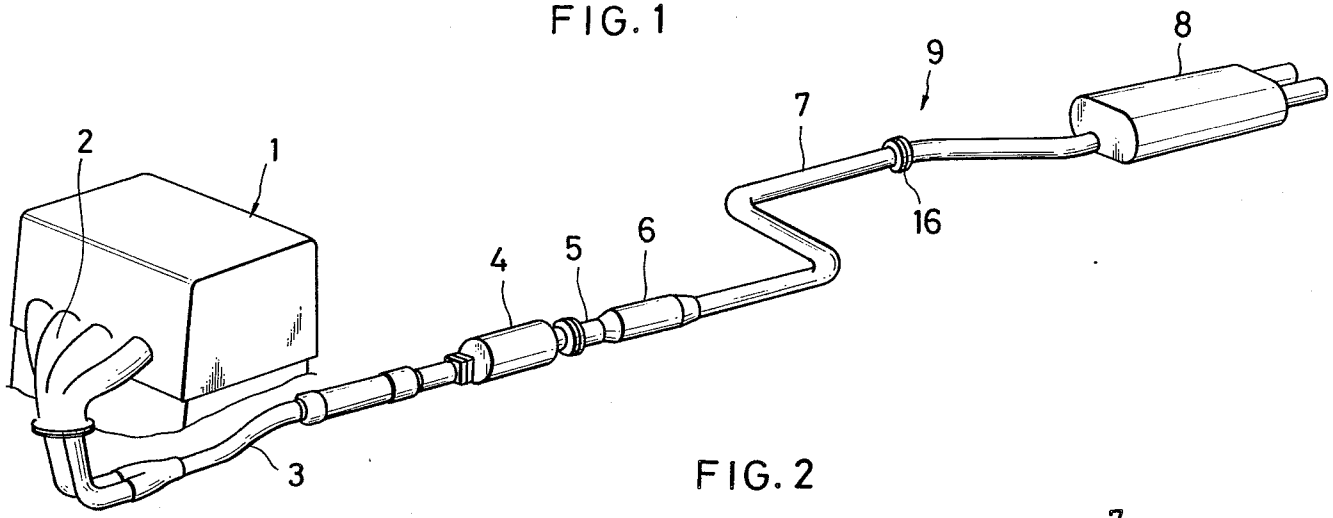
FIG. 1 is a schematic perspective view of an exhaust system of an internal combustion engine which is furnished with a silencing device in accordance with the present invention.

Referring to FIG. 1 of the drawings, there are shown an internal combustion engine 1, an exhaust manifold 2 connected to the engine 1, and a catalytic converter 4 connected to the exhaust manifold 2 through an exhaust pipe 3. Sequentially connected to the catalytic converter 4 are an exhaust pipe 5, a prechamber 6, an exhaust pipe 7, and a muffler 8. These parts in combination constitute an exhaust system which is generally designated by the reference numeral 9. In the exhaust system, exhaust gases emanating from the engine 1 are purified by the catalytic converter 4, then silenced by the prechamber 6 and muffler 8, and then discharged to the atmosphere.

Figure 2:
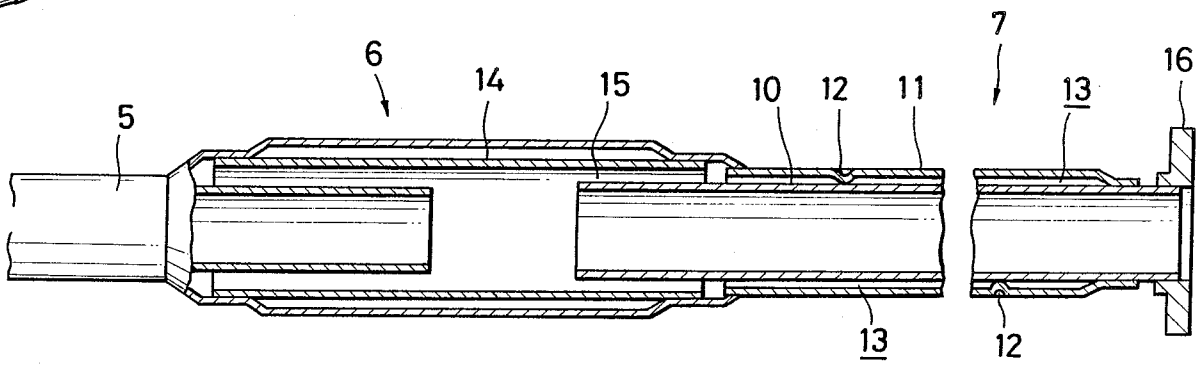
FIG. 2 is a vertical section of one embodiment of the silencing device.

The exhaust pipe 7 extending between the prechamber 6 and the muffler 8 has a substantially uniform section and a sufficient length. As shown in FIG. 2, the exhaust pipe 7 is made up of an inner conduit 10 and an outer conduit 11 which surrounds the inner conduit 10. The outer conduit 11 is provided with radially inwardly extending lugs 12 which are adapted to hold the inner conduit 10 concentrically with and at a substantially constant spacing from the outer tube 11. In this configuration, an annular air gap 13 is defined between the inner conduit 10 and the outer conduit 11.

The inner conduit 10 of the exhaust pipe 7 protrudes into the prechamber 6, which serves as an expansion chamber, over a sufficient length. The outer conduit 11, on the other hand, is contiguous with an inner wall 14 of the prechamber 6 which has a double-wall structure. Hence, both of the passageway in the inner conduit 10 and the air gap 13 between the inner conduit 10 and outer conduit 11 are fluidly communicated to the prechamber 6. Specifically, the air gap 13 is communicated at one end thereof to the prechamber 6 through an annular opening 15 which is defined between the inner tube 10 and the inner wall 14 of the prechamber 6.

At the other end, the exhaust pipe 7 is provide with a radially outwardly extending flange 16 which is connected to the muffler 8. The outer conduit 11 is joined with the inner conduit 10 in the vicinity of the flange 16. In this manner, the air gap 13 between the inner conduit 10 and the outer conduit 11 is open at one end into the expansion chamber with which the exhaust pipe 7 is contiguous, while being closed at the other end. Exhaust gases are caused to flow through the interior of the inner conduit 10.

In operation, exhaust gases which are emitted from the engine 1 and purified by the catalytic converter 4 are admitted into the prechamber 6. Because the prechamber 6 plays the role of an expansion chamber, the energy of sound waves of the exhaust gases entered the prechamber 6 interferes with each other and is thereby attenuated while being repeatedly reflected from wall to wall inside of the expansion chamber.

A part of the sound waves is passed through the opening 15 into the air gap 13 which is defined between the inner conduit 10 and the other conduit 11. The air gap 13 which is closed at the other end serves as a resonance chamber, whereby waves opposite in phase to the incoming sound waves are produced. Assuming that the length of the air gap 13 between the opening 15 and the closed end of the air gap 13 is l, and that the acoustic velocity is c, then the frequency of a wave which is developed in the resonance chamber, i.e, the resonance frequency f, is expressed as:

$$f = \frac{(2n-1) \times c}{4l}$$

(n=1, 2, 3, . . . )

The above equation implies that a wave which is equal in frequency to the resonance frequency f is cancelled.

The air gap 13 is sufficiently long because it is provided over substantially the entire length of the exhaust pipe 7. This, coupled with the fact that the opening 15 is positioned inside of the prechamber 6, provides the resonance chamber with an extremely great length l which in turn lowers the resonance frequency f to a significant degree. Stated another way, the resonance chamber is capable of attenuating noise of low frequencies. Further, because the opening 15 is formed over the entire circumference of the inner tube 10 and, therefore, has a sufficiently large area, a considerable amount of attenuation is guaranteed to offer an extra silencing effect.

The exhaust gases routed through the prechamber 6 and air gap 13 as stated above are fed to the muffler 8 to be further silenced thereby. In this instance, partly because the exhaust pipe 7 has a double-layer structure and partly because the air gap 13 forms an air layer around the inner conduit 10, not only the emission noise is reduced but also the radiation of heat of the exhaust gases to the outside is suppressed.

Figure 3:
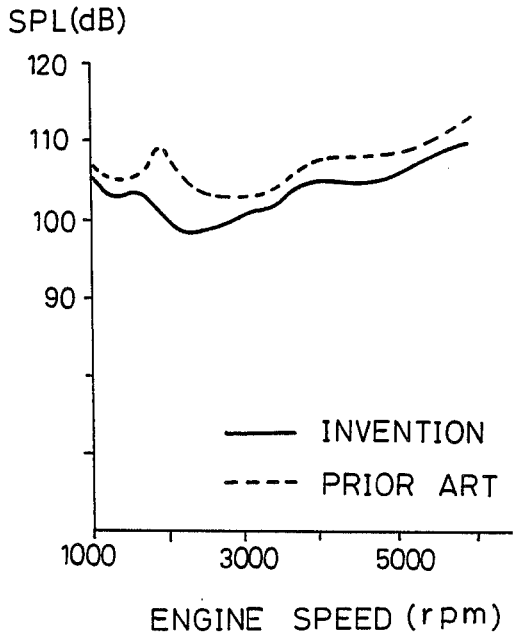
FIG. 3 is a plot showing experimental results which proves the reduction of sound pressure level (SPL) attainable with the present invention.

Referring to FIG. 3, there are shown sound pressure levels measured with the silencing device of the present invention having the above construction and those measured with a prior art silencing device which lacks the air gap, or resonance chamber, 13. The measurements were made under an accelerating condition of an engine. It will be seen from FIG. 3 that the device of the invention has a noticeable effect in C characteristic at engine speeds, especially, around 2000 r.p.m, and it was proved that noise whose frequency is as low as 70–80 Hz is remarkably attenuated.

In the embodiment shown and described, the exhaust pipe 7 extending between the prechamber 6 and the muffler 8 is provided with a double-layer structure, and the air gap 13 between the inner conduit 10 and the outer conduit 11 is open into the prechamber 6. Alternatively, the exhaust pipe 7 may be arranged to extend from the muffler 8 with the air gap 13 opened into the muffler 8, which would then serve as an expansion chamber. In such an alternative arrangement, the air gap 13 would be closed on the prechamber 6 side.

Further, the catalytic converter 4, too, plays the role of an expansion chamber. If desired, therefore, the exhaust pipe 3 or 5 which is connected to the converter 4 may be provided with a double-layer structure in order to define a resonance chamber in the above-described manner. The exhaust pipe 3 on the upstream side of the converter 4 and provided with a double-layer structure would serve to thermally insulate the exhaust gases flowing therethrough and, thereby, promote catalytic reactions.

Various modifications will become possible for those skilled in the art after receiving the teachings of the present disclosure without departing from the scope thereof.

What is claimed is:

1. A silencing device for exhaust gas of an internal combustion engine comprising:

an expansion chamber provided in an exhaust system of said engine; and an exhaust pipe having a double-layer structure consisting of an inner conduit connected to said expansion chamber and through which exhaust gases flow, and an outer conduit surrounding said inner conduit and defining an air gap between said inner and outer conduits, said air gap being open into said expansion chamber at one end thereof and closed at another end thereof; said expansion chamber having a double-wall structure consisting of an inner wall contiguous with said outer conduit of said exhaust pipe and an outer wall spaced from said inner wall, said inner conduit of said exhaust pipe being protruded into said expansion chamber.

2. A silencing device as claimed in claim 1, wherein said expansion chamber comprises a prechamber.

3. A silencing device as claimed in claim 1, wherein said expansion chamber comprises a muffler.

* * * * *